US008496515B2

(12) United States Patent
Bailey

(10) Patent No.: US 8,496,515 B2
(45) Date of Patent: Jul. 30, 2013

(54) APPARATUS TO PROTECT A RADON FAN FROM MECHANICAL FAILURE DUE TO DAMAGE FROM FALLING OBJECTS FROM WITHIN THE RADON MITIGATION SYSTEM

(75) Inventor: Wayne Edward Bailey, Fredericksburg, VA (US)

(73) Assignee: Wayne E. Bailey, Fredericksburg, VA (US)

( * ) Notice: Subject to any disclaimer, the term of this patent is extended or adjusted under 35 U.S.C. 154(b) by 126 days.

(21) Appl. No.: 13/068,620

(22) Filed: May 16, 2011

(65) Prior Publication Data

US 2012/0294708 A1 Nov. 22, 2012

(51) Int. Cl.
*F24F 7/06* (2006.01)

(52) U.S. Cl.
USPC ..... 454/341; 454/909; 137/312

(58) Field of Classification Search
USPC ..... 454/909, 341
See application file for complete search history.

(56) References Cited

U.S. PATENT DOCUMENTS

| | | | | | |
|---|---|---|---|---|---|
| 1,928,822 | A | * | 10/1933 | Schmidt | 126/99 R |
| 3,782,303 | A | * | 1/1974 | Pfister et al. | 110/162 |
| 4,182,376 | A | * | 1/1980 | Nilsson | 137/874 |
| 4,988,237 | A | | 1/1991 | Crawshaw | |
| 4,995,309 | A | * | 2/1991 | Weaver | 454/354 |
| 5,083,500 | A | | 1/1992 | Francis et al. | |
| 5,101,712 | A | | 4/1992 | Dean, Jr. | |
| 5,681,455 | A | * | 10/1997 | Takai et al. | 210/154 |
| 5,836,815 | A | | 11/1998 | Jennemann | |
| 6,029,505 | A | * | 2/2000 | Webb | 73/40.5 R |
| 6,527,005 | B2 | * | 3/2003 | Weaver | 137/312 |
| D501,533 | S | * | 2/2005 | Robinson et al. | D23/209 |
| 7,818,928 | B2 | * | 10/2010 | Brunt et al. | 52/218 |
| 2004/0155028 | A1 | * | 8/2004 | Doyle | 219/535 |
| 2007/0011808 | A1 | * | 1/2007 | Park | 4/679 |
| 2009/0197519 | A1 | * | 8/2009 | Craw et al. | 454/251 |

OTHER PUBLICATIONS

New Jersey Dept. of Environmental Protection, NJDEP responds to vapor mitigation system questions. Updated May 10, 2010.
"Draining water past radon fan motors installed outside" by Bill Brodhead of 2844 Slifer Valley Rd., Riegelsville, PA. www.wpb-radon.com.
Radon Today, by Radonaway, Winter issue 2008. Title:Condensation Bypass.
Radon Today, by Radonaway, Spring issue 2005. Title: Condensation II.
Radon Today, by Radonaway, Summer issue 2005. Title: Condensation III.
Radon Today, by Radonaway, Fall issue 2004. Title: Condensation.
Radon Today, by Radonaway, Spring issue 2003. Title: Mitigation System Winter Freeze-ups.

* cited by examiner

*Primary Examiner* — Steven B McAllister
*Assistant Examiner* — Jonathan Cotov

(57) ABSTRACT

This apparatus protects a radon fan from damage due to falling water, ice, birds and animals and debris and is installed above the radon fan and protects the fan in several ways.
It is installed just above the radon fan, thus taking advantage of warm "Earth Temperature" air to reduce ice build-up. Its screen replaces the birds and animals screen often installed at the top of the exhaust pipe where ice is formed. The screen additionally prevents ice and debris from falling into the fan. The water bypass catches back-flowing water and directs it around the fan. The access port serves as an opening for testing, observations and cleaning of any debris that is collected by the screen and the access port is sealed with a removable plug.
This apparatus protects and extends the life of a radon fan and is made part of the radon mitigation system.

5 Claims, 16 Drawing Sheets

APPARATUS TO PROTECT A RADON FAN FROM MECHANICAL FAILURE DUE TO DAMAGE FROM FALLING OBJECTS FROM WITHIN THE RADON MITIGATION SYSTEM

CROSS-REFERENCE TO RELATED APPLICATIONS 1. 61/397,142. Dated: Jun. 8, 2010
2. 61/401,438. Dated: Aug. 13, 2010
3. 61/459,188. Dated: Dec. 9, 2010
4. 61/461,132. dated: Jan. 14, 2011

OTHER REFERENCES

A. U.S. Pat. No. 6,527,005 Weaver May 14, 2001
B. New Jersey Dept. of Environmental Protection, NJDEP Responses to Vapor Mitigation System Questions, Updated 10 May 2010.
C. Suncourt Inc. Radon Fan Installation Instructions
D. "Draining Water Past Radon Fan Motors Installed Outside", by Bill Brodhead of 2844 Slifer Valley Rd., Riegelsville, Pa.
E. Radon Today, Published by: RadonAway and AccuStar Labs, Winter Issue-2008, Title: Condensation Bypass.
F. Radon Today, Published by: RadonAway and AccuStar, Winter-Spring Issue-2005, Title: Condensation II
G. Radon Today, Published by: RadonAway and AccuStar, Summer Issue-2005, Title: Condensation III
H. Radon Today, Published by: RadonAway and AccuStar, Fall Issue-2004, Title: Condensation
I. Radon Today, Published by; RadonAway and AccuStar, Spring Issue-2003, Title: Mitigation System Winter Freeze-ups.

FEDERALLY SPONSORED RESEARCH

This invention was not federally sponsored.

BACKGROUND

Radon is a cancer-causing, radioactive gas that has been found in homes all over the United States. Radon typically moves up through the ground to the air above and into a home through cracks and other holes in the foundation. You cannot see, smell, or taste radon.

Sub-slab depressurization is the most common radon mitigation technique which requires several installation steps.

The radon mitigation system is a continuous piping system beginning under a house concrete basement slab, and terminating outside and above the house. An in-line radon fan is installed in the piping system to draw the radon laced air from under the basement concrete slab to the outside and above the house.

The radon-laced air is pulled from under the basement concrete floor slab by the radon fan and pushed up the exhaust pipe and dispersed harmlessly into the environment.

The radon-laced air at earth temperature of about 50 degrees Fahrenheit with a high degree of moisture content. This produces air with high humidity content being vented through the radon mitigation system.

Radon mitigation protocol requires that radon mitigation systems be operational continuously. The radon mitigation system continues to operate during warm periods of the year and winter freezing periods of the year. During warmer periods, the humid air will turn to condensate and fall back into the radon fan in the form of water which causes damage to the radon fan.

Freezing temperatures in the environment during the winter causes condensate to turn to ice in the radon mitigation system exhaust pipe.

As more moist warm air is pumped into the exhaust pipe, ice continues to build and restrict air movement in the upper portion of the exhaust pipe. As the exhaust pipe becomes blocked with ice, the radon mitigation system becomes inoperative. During warmer periods the ice breaks apart from the exhaust pipe and falls into the radon fan, causing fan damage. It is common for winter nights to freeze and winter days to thaw, resulting in many freeze-thaw cycles during a winter season.

Adding to the ice build-up problem is the birds and animals and debris screen-cap, which is often installed at the top end of the exhaust pipe where the humid air is exposed to the freezing temperature of the environment. The screen-cap, installed at the top of the exhaust pipe is directly exposed to freezing temperatures, thus the screen compounds the ice build-up problem as it catches moisture from the air passes through the screen and increases ice build-up. The ice will partially melt, and pieces will break off and drop down into the radon fan, causing damage.

The damage to the radon fan from falling ice is a health and economic problem because when the radon fan is not operating, radon is not being removed from the house. Therefore it is desirable to provide an apparatus that will prevent ice, water, birds and animals and debris from entering the radon fan, and continue to allow maximum air passage through the radon mitigation system. It would also be desirable to provide a means for maintenance and system testing of the radon mitigation system.

This embodiment relates to radon mitigation systems, specifically to an improved separator apparatus as part of the radon system. This embodiment protects a radon fan from damage resulting from falling ice, debris, birds and animals and water.

This embodiment would have a means to replace the traditional screen cap at the top of the exhaust pipe, resulting in clear exit pipe opening.

This embodiment would have a means of preventing falling ice, debris, birds and animals and water from falling into a radon fan of a radon mitigation system.

This embodiment would have a means to access and clean-out debris and birds and animals that became suspended within the embodiment.

This embodiment would have a means to catch falling water and channel it out and around the radon fan housing.

This embodiment would have a means to return the water to the radon mitigation system down-stream of the radon fan.

It is also desirable to locate the embodiment up-stream and adjacent to the radon fan.

This embodiment would have a means to allow access for radon mitigation system annalists within the embodiment.

This embodiment would install quickly and easily to the radon mitigation system and become part of the radon mitigation system.

PRIOR ART

Currently a radon fan can be somewhat protected from returning water with a condensate bypass apparatus, U.S. Pat. No. 6,527,005 issued to Weaver, Mar. 4, 2003. However, Weaver does not teach:

(1) preventing ice, birds, animals and debris from falling into a radon fan.

(2) providing an access port into the condensate bypass apparatus for inspections, cleaning and testing of the exhausting air.

(3) Providing for the condensate bypass trap to be at an angle or elbow shape housing to further shield the radon fan from ice falling directly on it.

(4) Providing for the condensate bypass trap to be at an angle or elbow shape housing to further assist in the flow of condensate by gravity out of the condensate bypass trap.

(5) Provide a second port with a removable drain tube coupling for cleaning coupling and drain tube.

SUMMARY

This present invention comprises a radon mitigation system for removing radon-laced air from occupied areas of a building, including a means for preventing falling debris, birds and animals, ice and water from entering a radon fan of a radon mitigation system.

The separator housing of the present invention comprises of gutters, screens, test port, access port, access port plugs, drain ports, drain tube adapters, drain tube and support devices.

These and other features and advantages of the present invention, and the manner of attaining them, will be more apparent and better understood by reference to the following descriptions of embodiments of the invention taken in conjunction with the accompanying drawings and with the claims.

REFERANCE NUMERALS

1. Separator apparatus.
1*a*. Separator housing
2. Elliptical cone gutter
2*a*. Semi-curved gutter
2*b*. Flattened gutter
3. Flat screen
3*a*. Domed screen
4. Support screws
5. Drain tube adapter
6. Drain tube
7. Drain tube adapter
8. Drain tube insulation
9. Sealant
11. Slip connector
12. Coupling
12*a*. Connector port plug
12*b*. Rear connector port plug
13. Trough screw
14. Trough base.
15. Trough interior side wall.
19. Trough channel.
20. Test port
21. Access port plug threads
22. Access port threads
23. Collection area above screen
24. Birds and animals screen cap
25. Access port to housing
25*a*. Access port to slip connector
25*b*. Rear connector port
26. Drain port to coupling
26*a*. Drain port to housing
100. Radon fan.
110. Flexible fan coupling.
120. Flexible fan coupling.
130. Pipe elbow.
140. Suction pipe.
150. Pipe elbow
160. Exhaust pipe.
170. Support bracket.
180. Building exterior wall.
200. Radon mitigation system.
W. Water

DETAILED DESCRIPTION

The invention is best described with reference to the drawings.

Figure 1:
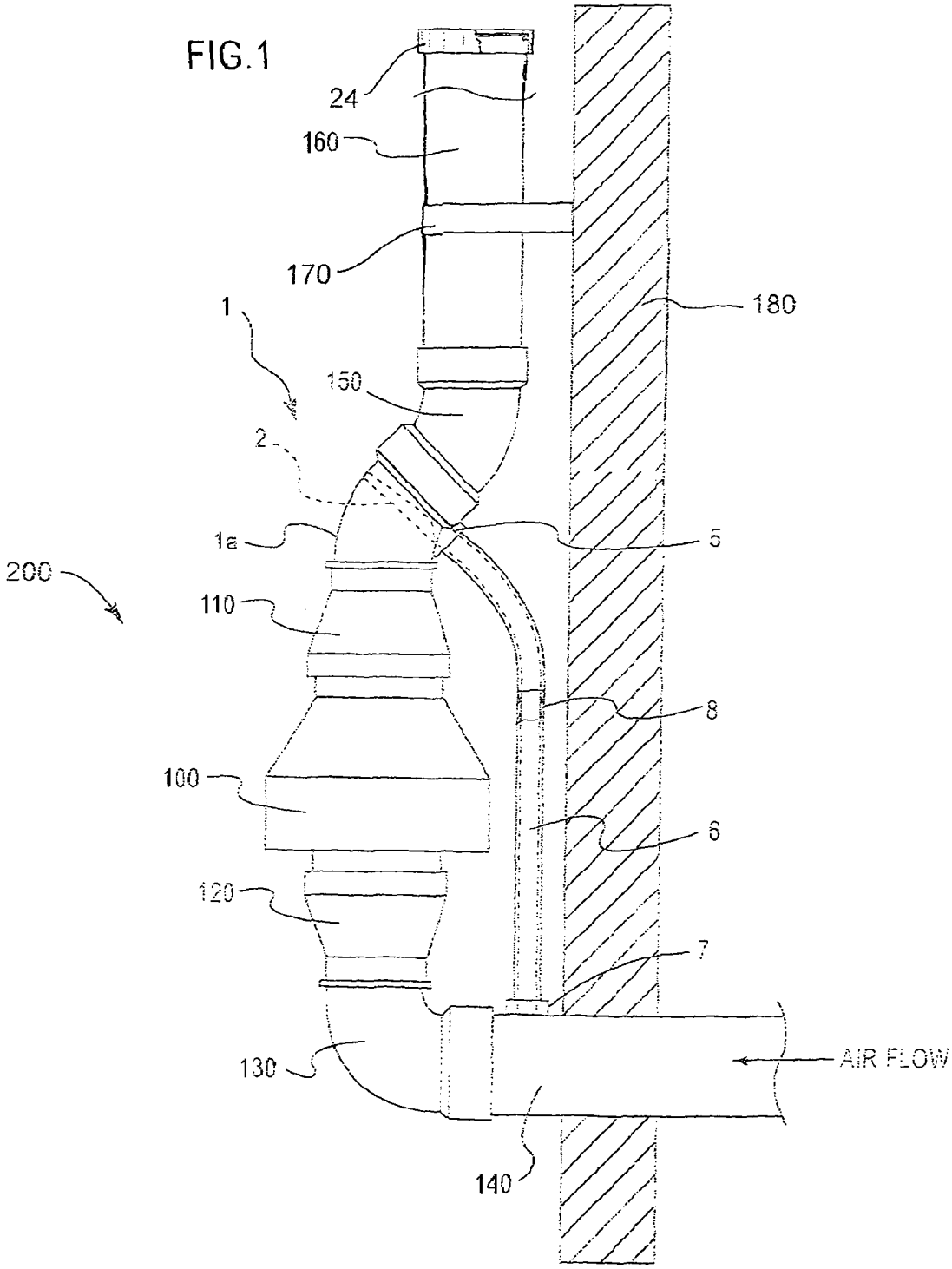
FIG. 1 Shows overall view of radon mitigation system.

FIG. 1 Shows a overall side view of a radon mitigation system (200) comprising separator apparatus (1), suction pipe (140), pipe elbow (130), flexible fan coupling (120), radon fan (100), flexible fan coupling(110), pipe elbow(150), exhaust pipe(160), support bracket (170), building exterior wall (180), birds and animals screen cap (24).

Separator housing (1*a*) comprising, elliptical cone gutter (2), drain tube adapter (5), drain tube (6), drain tube adapter (7), drain tube insulation (8). I contemplate that the drain tube adapter (5) of this embodiment be made of plastic, but other materials are also suitable.

Suction pipe (140) comprises a pipe from below basement floor up-stream to pipe elbow (130). Pipe elbow (130) engages suction pipe (140) down-stream and engages flexible fan coupling (120) up-stream. Flexible fan coupling (120) engages pipe elbow (130) down-stream and engages radon fan (100) up-stream. Suction pipe (140), pipe elbow (130) and flexible fan coupling (120) forms a continuing hollow, substantially airtight channel from below basement slab to radon fan (100).

Radon fan (100) engages flexible fan coupling (120) down-stream and engages flexible fan coupling (110) up-stream. Radon fan (100) is an exhaust fan well known in the radon mitigation industry. Flexible fan coupling (110) engages radon fan (100) down-stream and engages separator housing (1*a*) up-stream. Separator Housing (1*a*) engages flexible fan coupling (110) down-stream and engages pipe elbow (150) up-stream. Pipe elbow (150) engages separator housing (1*a*) down-stream and engages exhaust pipe (160) up-stream. Exhaust pipe (160) engages pipe elbow (150) down-stream and engages birds and animals screen cap (24) up-stream. Birds and animals screen Cap (24) engages exhaust pipe (160) down-stream and terminates up-stream. Flexible fan coupling (110), separator housing (1*a*), pipe elbow (150), exhaust pipe (160) and birds and animals screen cap (24) forms a continuing hollow, substantially airtight channel from radon fan (100) to exit through birds and animals screen cap (24). Support bracket (170) engages exhaust pipe (160) and engages building exterior wall (180).

I contemplate that the fittings and pipe of this embodiment be made of Polyvinyl Chloride (PVC), but other materials are also suitable.

I contemplate that the fittings and pipe are of 4" diameter, but other sizes are also suitable.

FIG. 1. Separator Housing (1*a*) of this embodiment comprises elliptical cone gutter (2), drain tube adapter (5), drain tube insulation (8), drain tube (6), and drain tube adapter (7).

All components down-stream of radon fan (100), including suction pipe (140), pipe elbow (130), flexible fan coupling (120), comprise the suction side of the radon mitigation system.

All components up-stream of radon fan (100), including flexible fan coupling(110), separator housing(1*a*), pipe elbow (150), exhaust pipe(160), support bracket (170), birds and animals screen cap (24) comprise the exhaust side of the radon mitigation system.

Birds and animals screen Cap (24) is a metal screen, plastic housing device sized to fit onto pipe (160) to prevent birds and animals and debris from entering radon mitigation system (200).

I contemplate that suction pipe (140), pipe elbow (130), separator housing (1*a*), pipe elbow (150), exhaust pipe (160) is are pipes and fittings manufactured of Polyvinyl Chloride (PVC) and are well known in the plumbing trade. All male and female slip connection fittings are mated using PVC primer and PVC solvent cement.

I contemplate that flexible fan coupling (110) and flexible fan coupling (120) are manufactured of flexible elastomeric compounds with stainless steel band clamps for leak-proof seals and are well known in the plumbing trade. Radon mitigation system (200) is shown in FIGS. 1, 10, 18, 19.

Figure 9:
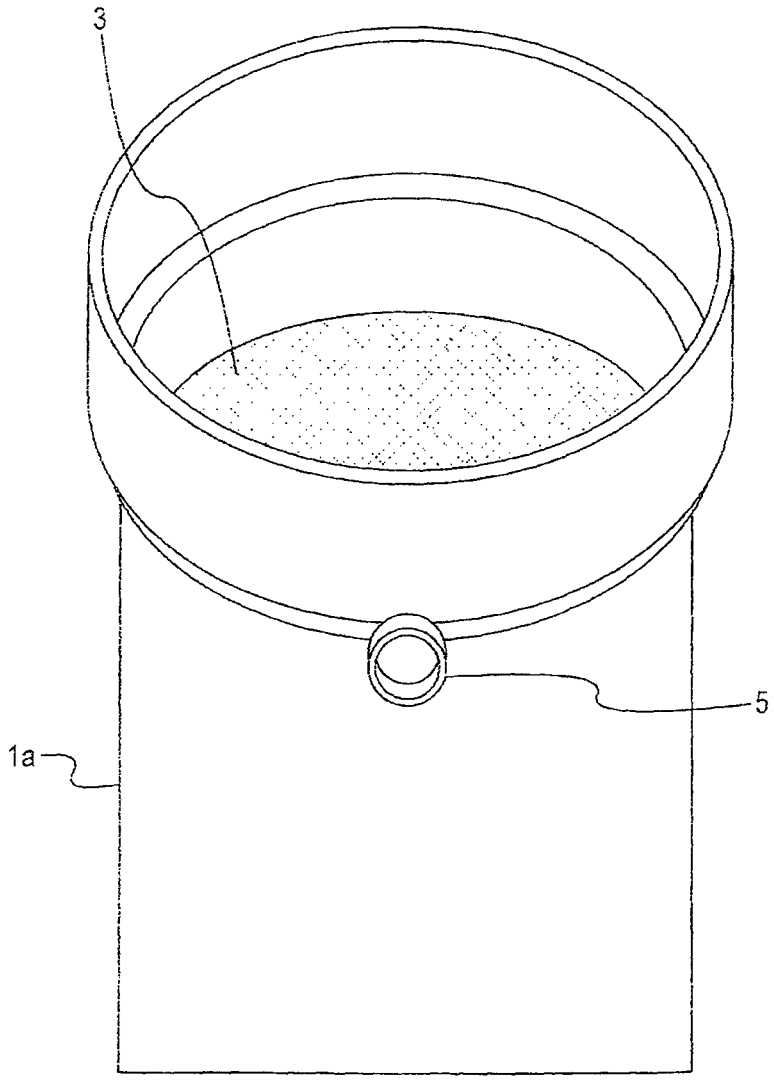
FIG. 9 Shows front view of separator housing, screen and drain tube adapter.
Figure 10:
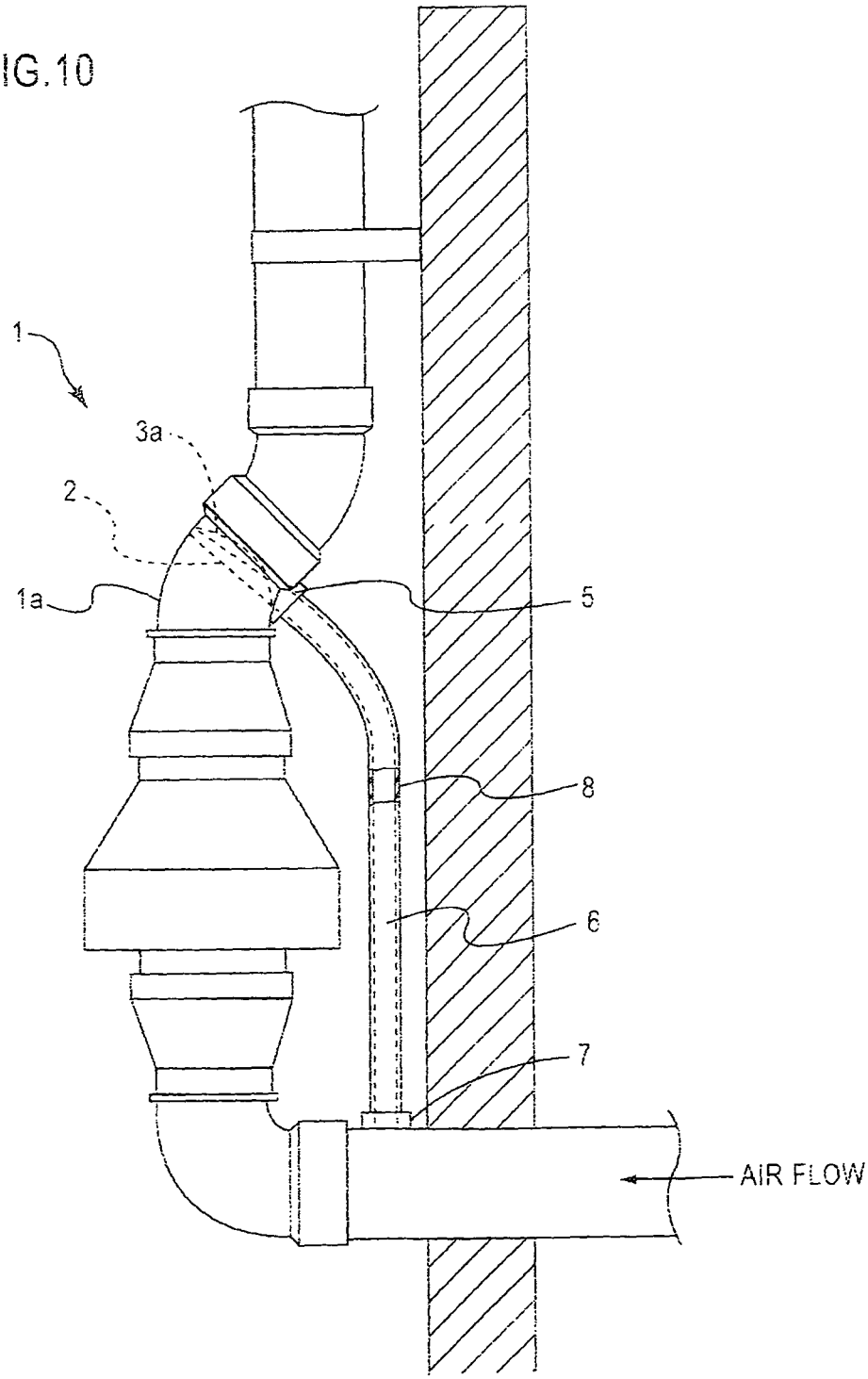
FIG. 10 Shows side view of separator apparatus.

Separator apparatus (1) is a component of radon mitigation system (200) Separator housing (1*a*) is an embodiment of separator apparatus (1) is shown in FIGS. 1, 10. Separator housing (1*a*) is shown in FIGS. 7, 8,9,19,20,21,22. Separator housing (1*a*) comprises a hollow plumbing elbow, engages flexible fan coupling (110) and pipe elbow (150).

I contemplate that the separator housing(1*a*) of this embodiment be made of a hollow plumbing Polyvinyl Chloride (PVC) elbow and angled to 90 degrees or 45 degrees to engage standard PVC pipe and fittings common to the plumbing industry, but other materials are also suitable.

Figure 2:
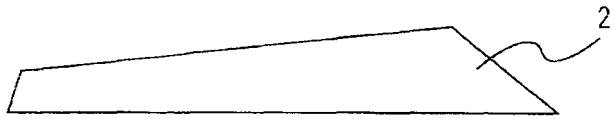
FIG. 2 Shows side view of elliptical cone shaped gutter.

FIG. 2 shows a side view of an embodiment of elliptical cone gutter (2) shown in FIG. 1.

I contemplate that the elliptical cone gutter (2) of this embodiment be made of a corrosion-resistant material, such as aluminum or a plastic, but other materials are also suitable.

Figure 3:
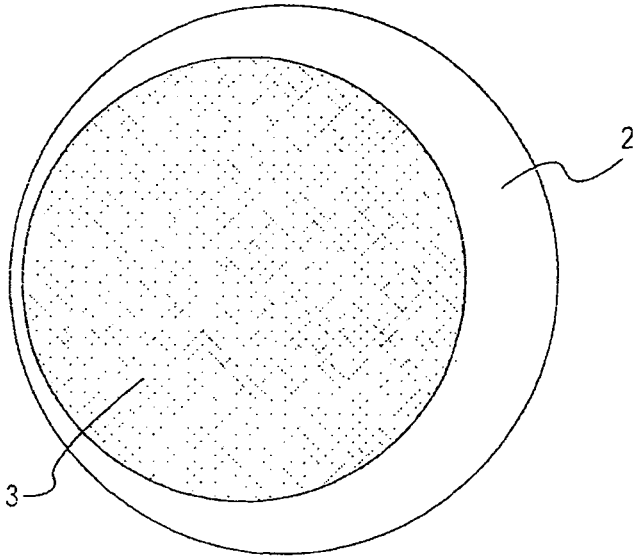
FIG. 3 Shows bottom view of elliptical cone shaped gutter and flat screen.

FIG. 3 Shows a below view of the elliptical cone gutter (2) engaged with flat screen (3). In this embodiment elliptical cone gutter (2) is placed below the flat screen (3). In this embodiment elliptical cone gutter (2) supports flat screen (3). In this embodiment elliptical cone gutter (2) is attached to flat screen (3). Elliptical cone gutter (2) semi-curved gutter (2*a*) and flat screen (3), are bonded to separator housing (1*a*) with waterproof sealant (9) FIG. 7.

Figure 4:
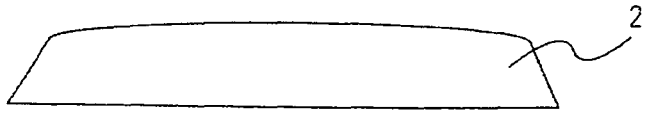
FIG. 4 Shows front view of elliptical cone shaped gutter.

FIG. 4 Shows front view of elliptical cone gutter (2).

Figure 5:
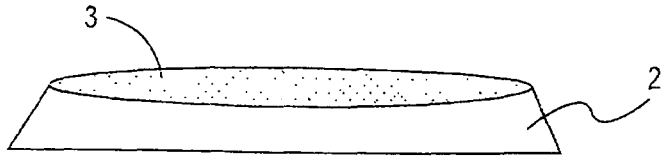
FIG. 5 Shows rear view of elliptical cone shaped gutter and flat screen.

FIG. 5 shows a rear view of elliptical cone gutter (2) engaged with flat screen (3) above elliptical cone gutter (2).

Figure 6:
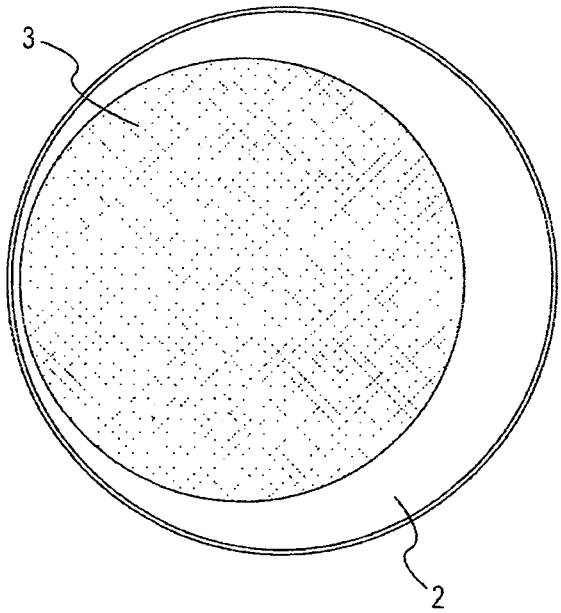
FIG. 6 Shows top view of elliptical cone shaped gutter and flat screen.

FIG. 6 Shows a below view of-elliptical cone gutter (2) as a base support for flat screen (3). I contemplate that the flat screen (3) be made of stainless steel mesh and 0.50 inch openings, but other materials and other screen sizes are also suitable.

Figure 7:
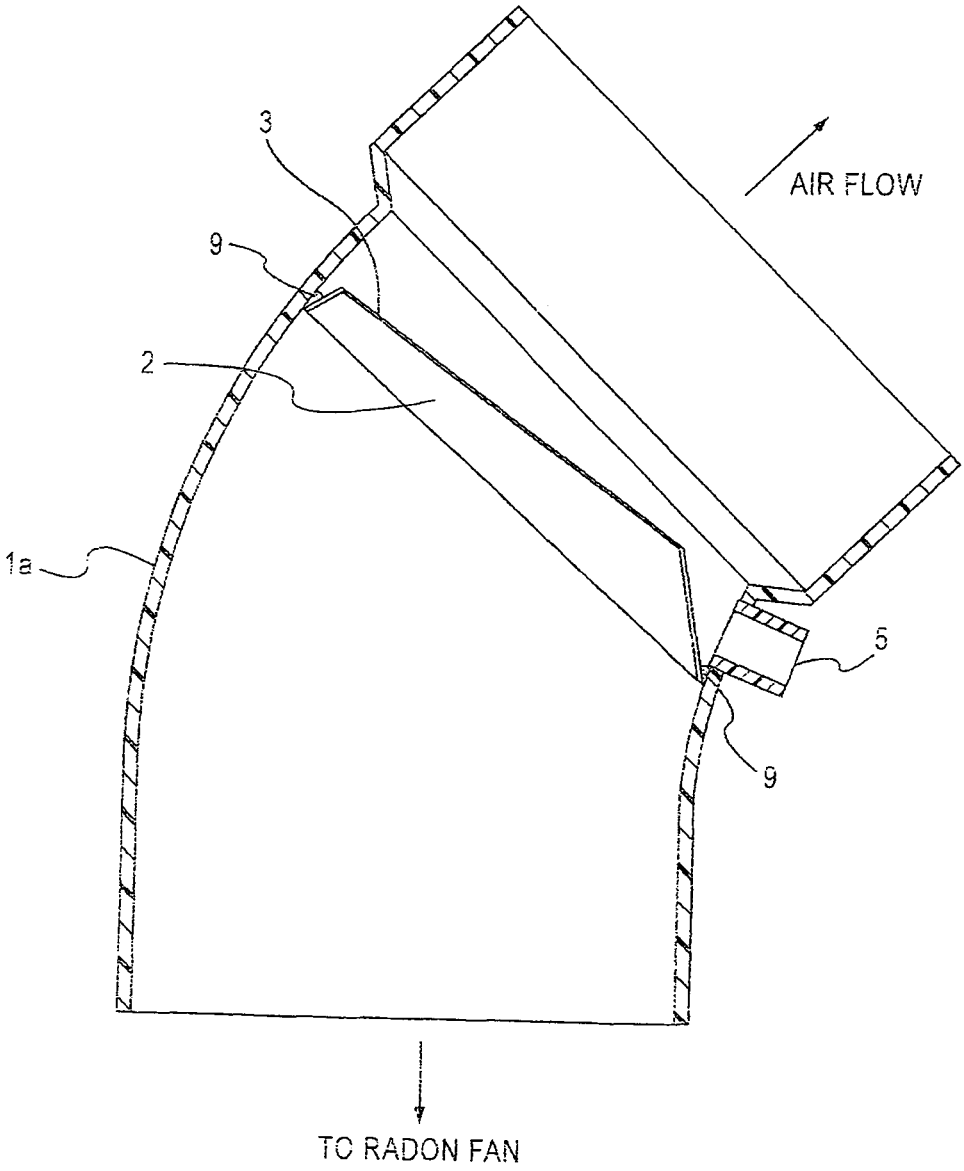
FIG. 7 Shows side view of separator housing, screen, gutter, drain tube adapter, and sealant.

FIG. 7 shows a side view of separator housing (1*a*), elliptical cone gutter (2), flat screen (3), drain tube adapter (5), and sealant (9). Flat screen (3) is above elliptical cone gutter (2). Flat Screen (3) is supported by elliptical cone gutter (2). Elliptical cone gutter (2) is seated into sealant (9).

I contemplate that sealant (9) be waterproof and flexible Silicone, but other materials are also suitable.

Figure 8:
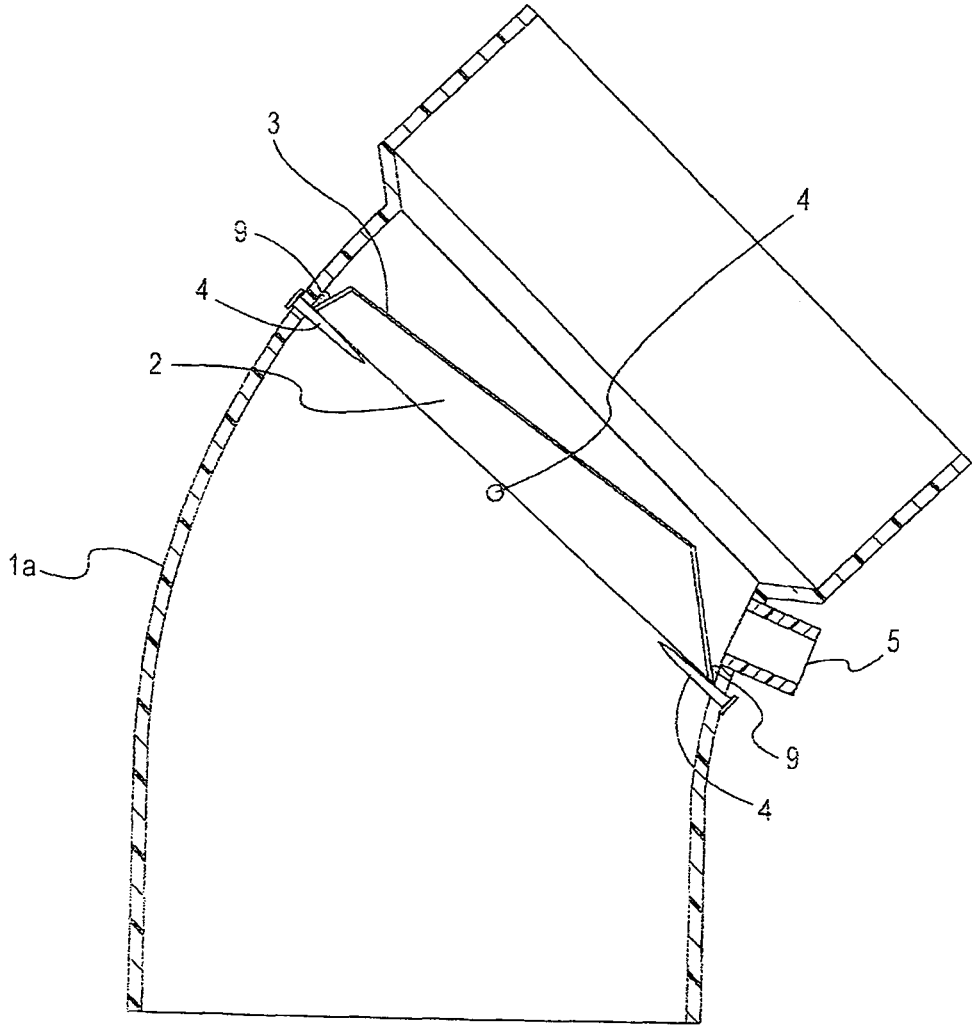
FIG. 8 shows a side view of separator housing, gutter, screen, support screws, drain tube adapter, and sealant.

FIG. 8 shows a side view of separator housing (1*a*), elliptical cone gutter (2), flat screen (3), support screws (4), drain tube adapter (5), and sealant (9). Support screws (4) embedded into separator housing (1*a*) supports in place elliptical cone gutter (2) and flat screen (3). Drain tube adapter (5) receives water from elliptical cone gutter (2).

FIG. 9 shows the front view of separator housing (1*a*), flat screen (3), and drain tube adapter (5) installed.

FIG. 10 Shows side view of separator apparatus (1) embodiments, consisting of separator housing (1*a*), elliptical cone gutter (2), domed screen (3*a*), drain tube adapter (5), drain tube (6), drain tube adapter (7), drain tube insulation (8). In this embodiment domed screen (3*a*) allows smaller gauge screen due to arch design for added strength.

I contemplate that the drain tube (6) of this embodiment be made of vinyl, but other materials are also suitable.

I contemplate that the drain tube (6) of this embodiment be sized ⅜" ID by ½" OD, but other sizes are also suitable.

I contemplate that drain tube adapter (5) drain tube adapter (7) be manufactured of plastic compound with ⅜" MNPT threads at one end and the other being ⅜" barbed receiving end, but other materials are also suitable.

Figure 11:
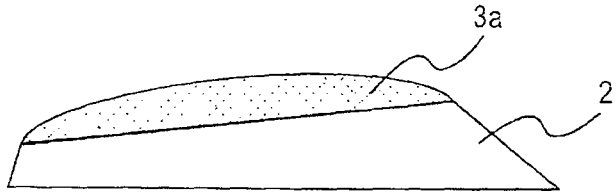
FIG. 11 Shows a side view of elliptical cone shaped gutter and domed screen.

FIG. 11 Shows side view of elliptical cone gutter (2) engaged with domed screen (3*a*). In this embodiment, domed screen (3*a*) is domed to maximize weight bearing qualities.

Figure 12:
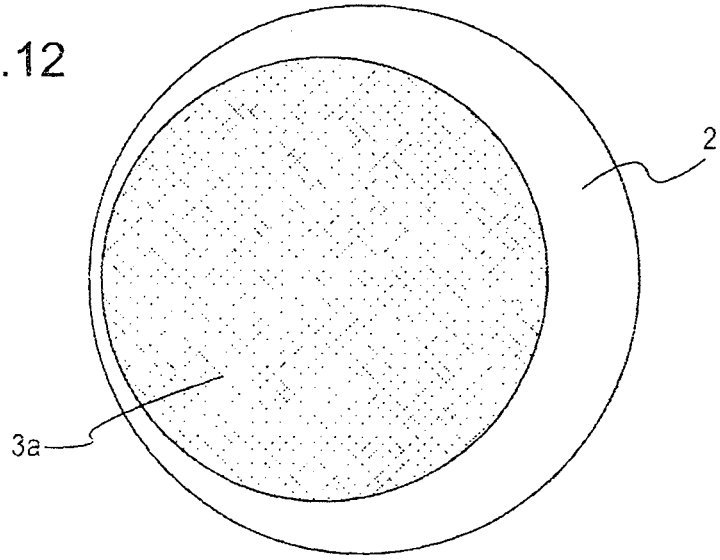
FIG. 12 Shows bottom view of elliptical cone shaped gutter and domed screen.

FIG. 12 Shows below view of elliptical cone gutter (2) engaged with domed screen (3*a*). In this embodiment domed screen (3*a*) is above elliptical cone gutter (2) and is supported by elliptical cone gutter (2).

Figure 13:
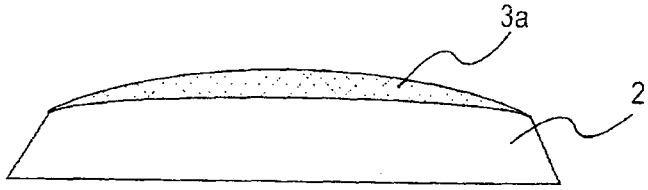
FIG. 13 Shows front view of elliptical cone shaped gutter and domed screen.

FIG. 13 Shows front view of elliptical cone gutter (2) engaged with domed screen (3*a*). In this embodiment, domed screen (3*a*) is supported by elliptical cone gutter (2).

Figure 14:
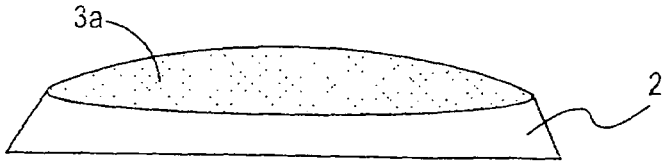
FIG. 14 Shows rear view of elliptical cone shaped gutter and domed screen.

FIG. 14 shows rear view of elliptical cone gutter (2) engaged with domed screen (3*a*). In this embodiment, elliptical cone gutter (2) is reduced in size at rear to allow maximum air passage.

Figure 15:
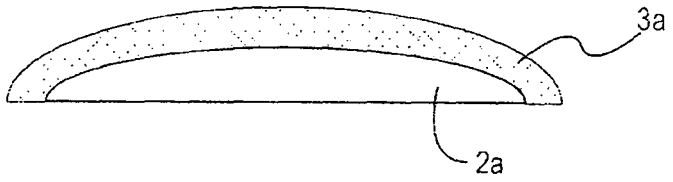
FIG. 15 Shows front view of domed gutter and a domed screen.

FIG. 15 Shows front view of semi-curved gutter (2*a*) engaged with domed screen (3*a*). In this embodiment size and shape of semi-curved gutter (2*a*) allows additional air passage.

Figure 16:
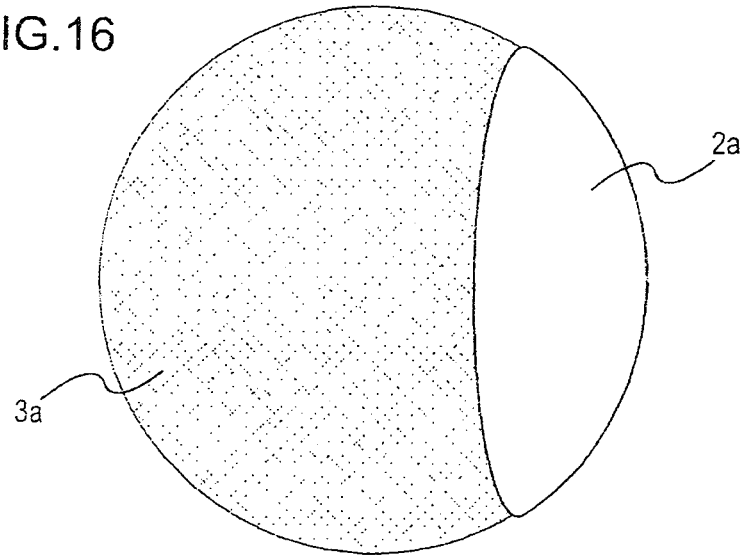
FIG. 16 Shows top view of domed gutter and domed screen.

FIG. 16 Shows top view of semi-curved gutter (2*a*) engaged with domed screen (3*a*). In this embodiment domed screen maximizes strength to minimize screen wire gauge for maximum air passage.

Figure 17:
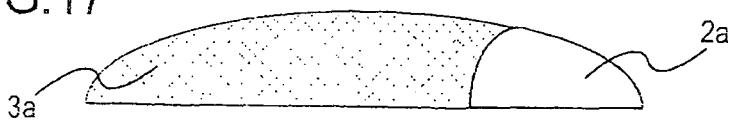
FIG. 17 Shows side view of domed gutter and domed screen.

FIG. 17 Shows side view of semi-curved gutter (2*a*) engaged with domed screen (3*a*) to maximize air flow efficiency.

Figure 18:
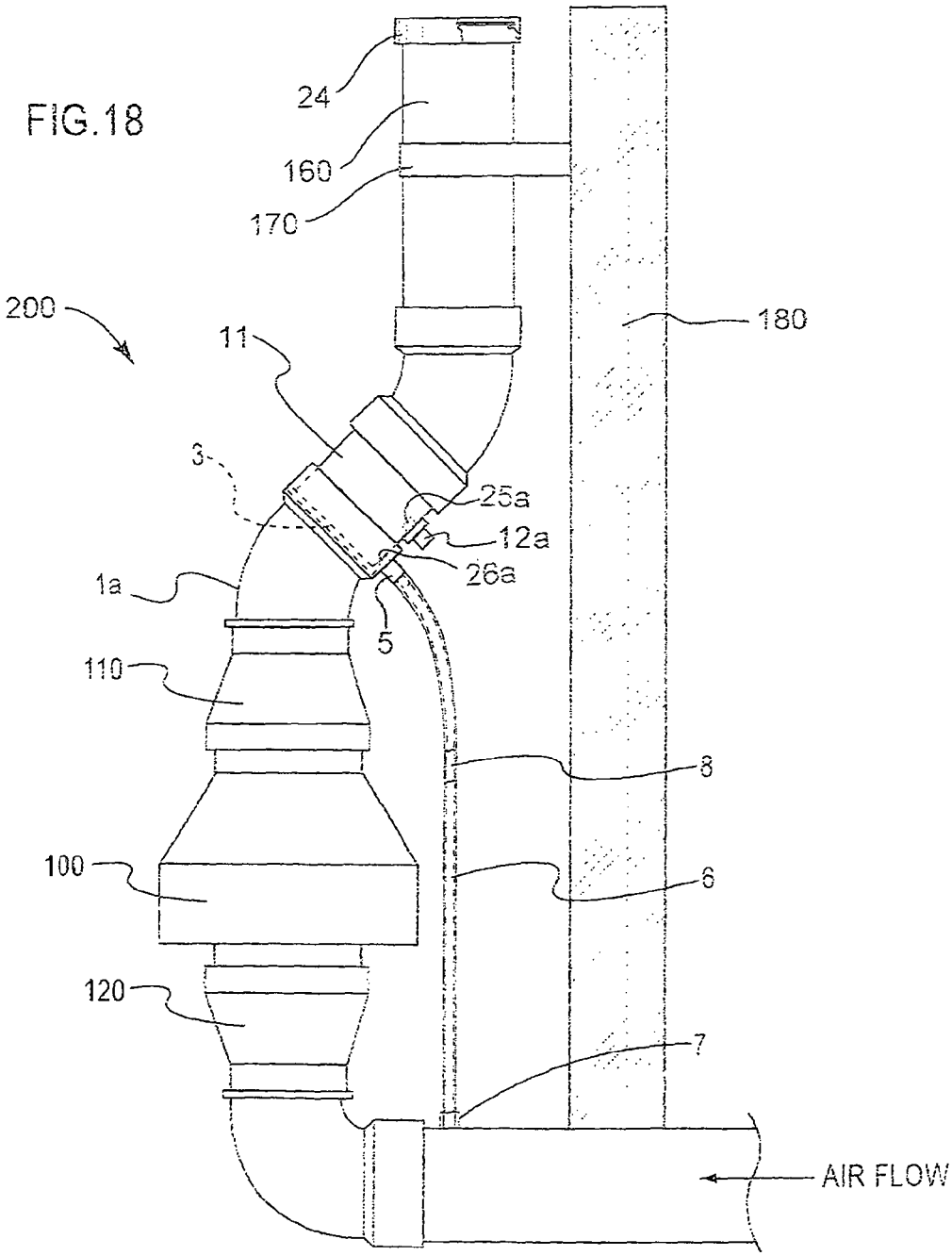
FIG. 18 Shows side view of radon mitigation system.

FIG. 18 This embodiment shows side view of radon mitigation system (200) with birds and animals screen cap (24), support bracket (170) and building exterior wall (180).

Shows side view of birds and animals screen cap (24) engaged with exhaust pipe (160). This embodiment shows support bracket (170) engaged with exhaust pipe (160) and building exterior wall (180).

Shows side view of slip connector (11) engaged with separator housing (1*a*) and engaged with pipe elbow (150).

Shows side view of drain tube adapter (5) engaged with access port to connector (26*a*) of separator housing (1*a*).

Shows side view of access port to connector (26*a*) of separator housing (1*a*).

Shows side view of connector port plug (12*a*) engaged with access port to connector (25*a*) of slip connector (11).

Shows side view of access port to connector (25*a*) of slip connector (11). Shows side view of flat screen (3) of separator housing (1*a*).

Figure 19:
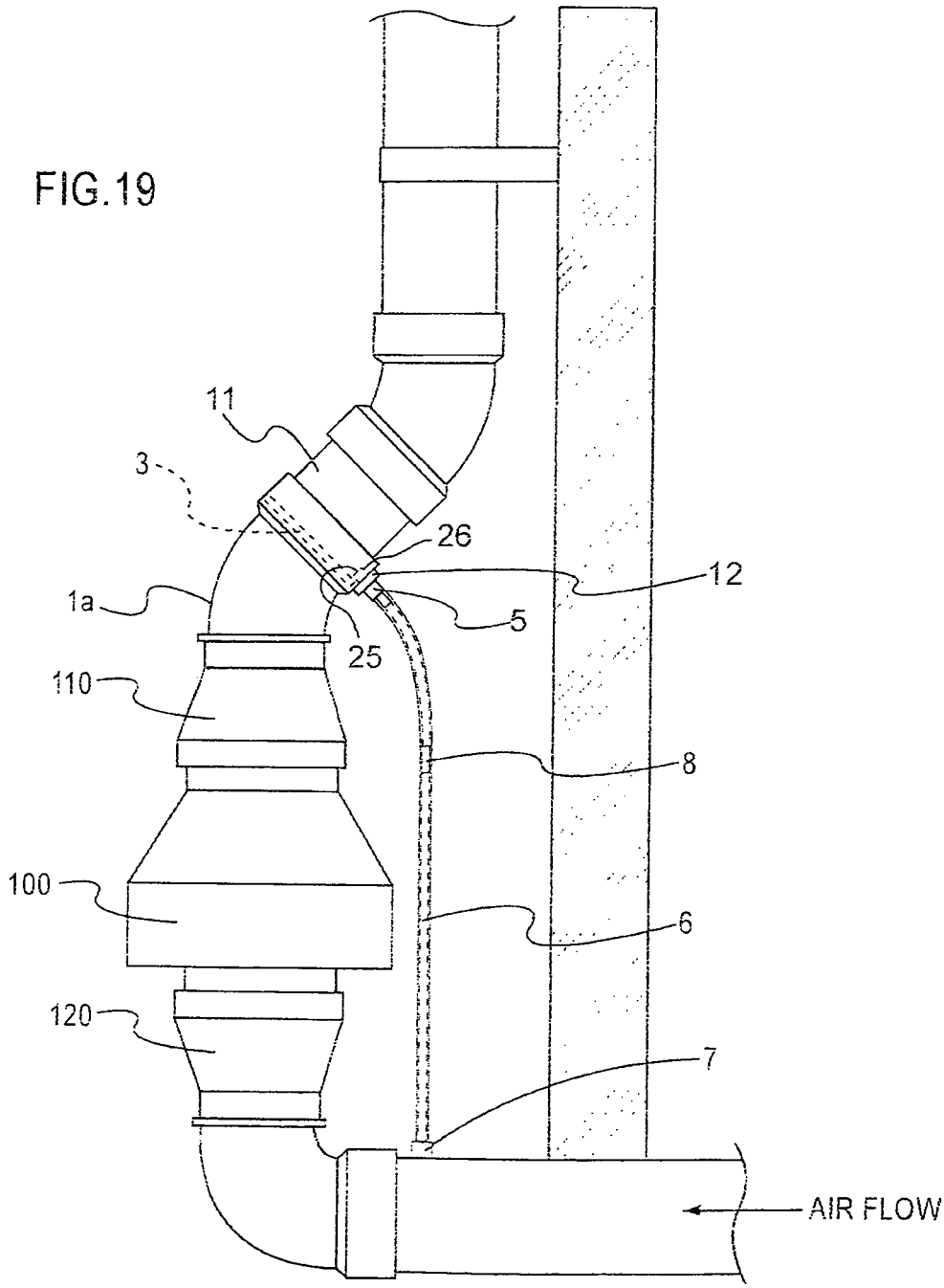
FIG. 19 Shows side view of separator housing.

FIG. 19. This embodiment shows side view of separator housing (1*a*). Shows side view of slip connector (11) engaged with separator housing (1*a*)

Shows side view of drain tube adapter (5) engaged with drain port to coupling (26) of coupling (12).

Shows side view of coupling (12) engaged with access port (25) of separator housing (1*a*).

Figure 24:
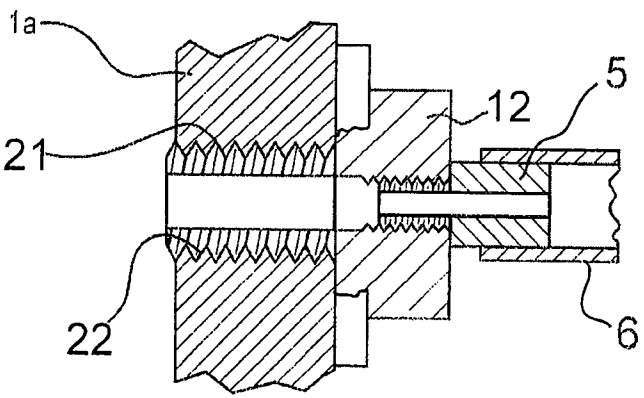
FIG. 24 Shows cross-section view of drain tube adapter screwed into drain port plug and drain port plug screwed into separator housing.

I contemplate that coupling (12) be sized and threaded with 1.25"-11.5 NPT threads and has a square head installed with ⅜" threads to mate with ⅜" threads of drain tube adapter (5) FIG. 24, but other materials are also suitable.

Shows side view of drain port to coupling (26) engaged with coupling (12). Shows side view of access port to housing (25) of separator housing (1*a*). Shows side view of flat screen (3) within separator housing (1*a*) below access port to housing (25).

Figure 20:
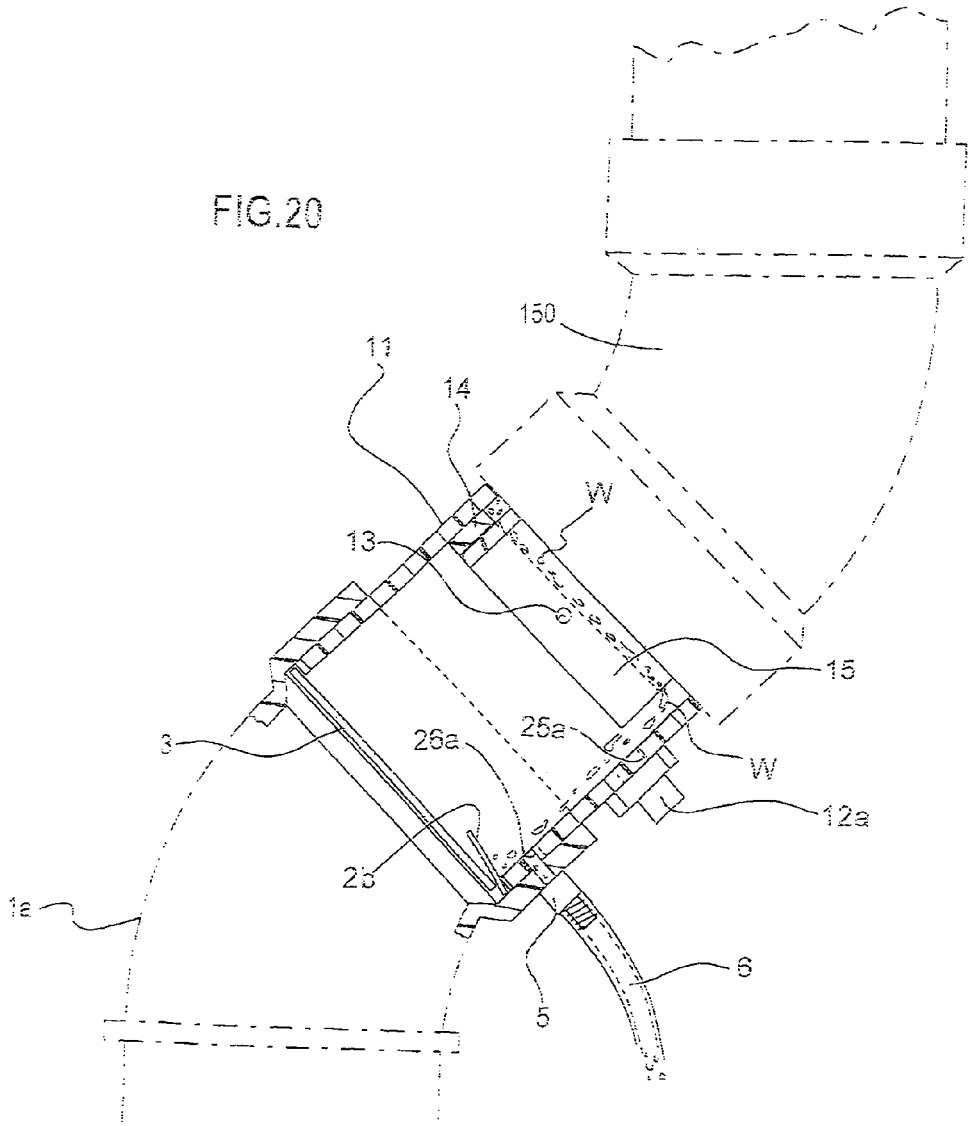
FIG. 20 Shows cross sectional view of embodiments of separator housing.

FIG. 20. This embodiment shows cross sectional view of separator housing (1*a*).

Shows side view of sloped and flattened gutter (2*b*) sloped to drain port to housing (26*a*) above flat screen (3) within separator housing (1*a*). Shows side view of flat screen (3) below flattened gutter (2*b*) and below drain port to housing (26*a*).

Shows side view of-slip connector (11) engaged with access port to connector (25*a*) and engaged with drain port to housing (26*a*). Slip Connector (11) down-stream end slips into female up-stream hub of separator housing (1*a*). Slip Connector (11) up-stream end slips into female down-stream hub of pipe elbow (150). Slip Connector (11) is manufactured PVC pipe of proper size to mate with separator housing (1*a*) and pipe elbow (150).

Figure 22:
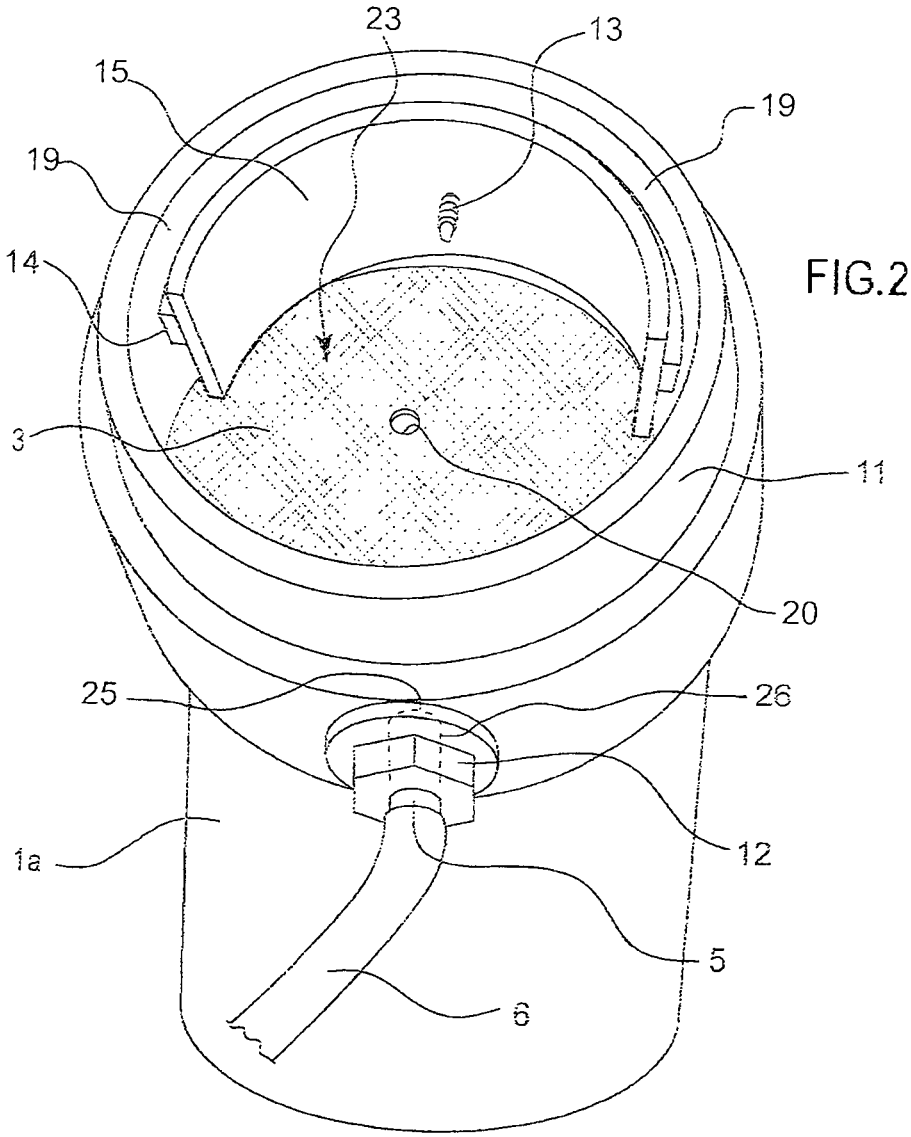
FIG. 22 Shows prospective view of embodiments.

Shows side view of base trough base (14) engaged with slip connector (11) and trough interior side wall (15) by trough screw (13) to form a trough channel (19) FIG. 22.

Shows cross sectional view of trough interior side wall (15) engaged with trough base (14) and slip connector (11) by trough screw (13). Trough Base (14) and trough interior side wall (15) is manufactured PVC pipe of proper size and shape to form trough base (14) and trough interior side wall (15). Shows side view of connector port plug (12*a*) engaged with access port to connector (25*a*).

Shows side view of drain tube adapter (5) engaged with drain port to housing (26*a*) of separator housing (1*a*) and into slip connector (11).

Figure 21:
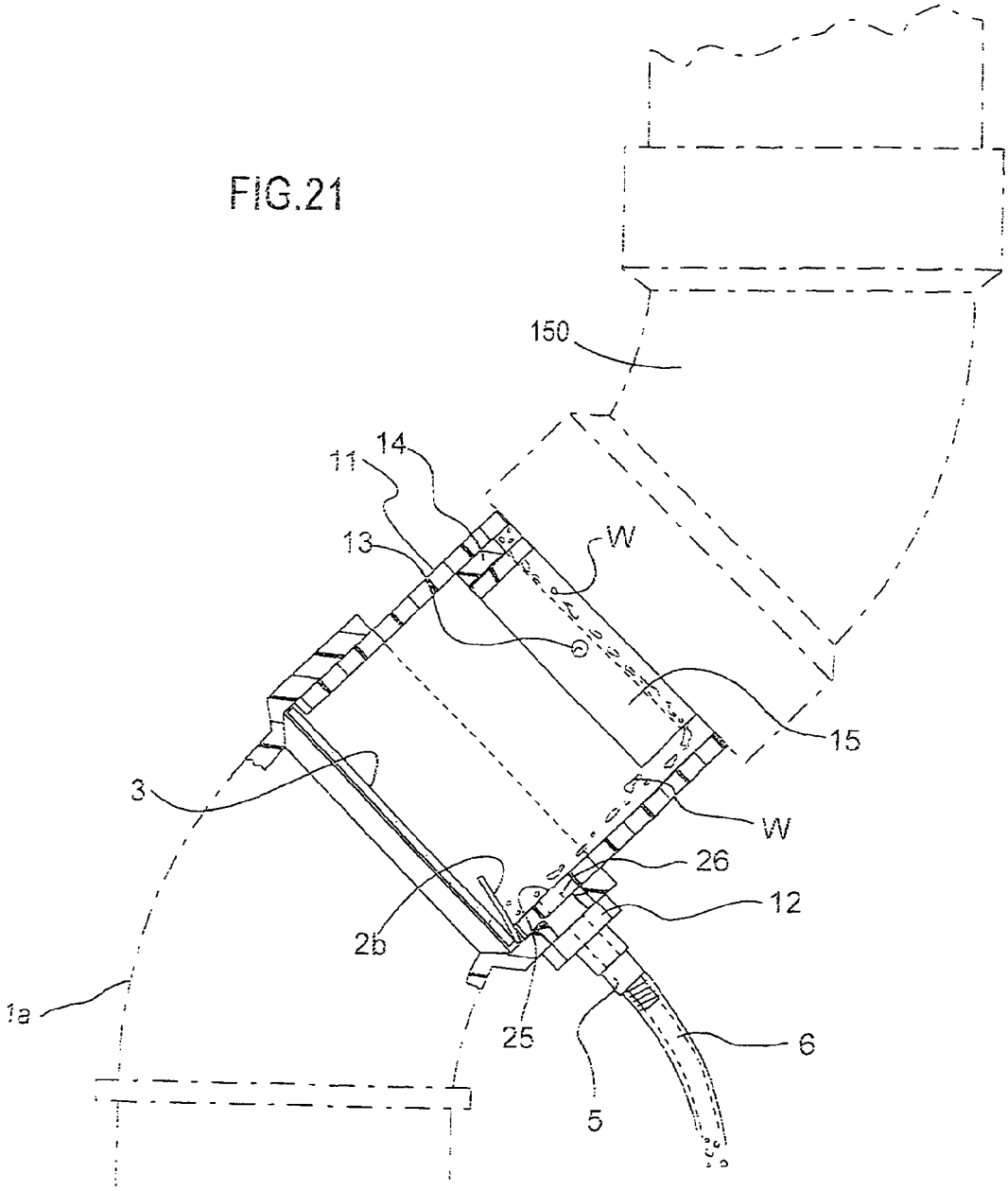
FIG. 21 Shows cross sectional view of another embodiment of separator housing.

FIG. 21. This embodiment shows cross sectional view of separator housing (1*a*).

Shows view of sloped and flattened gutter (2*b*) sloped to access port to housing (25) above flat screen (3) within separator housing (1*a*).

Shows cross sectional view of flat screen (3) within separator housing (1*a*). Shows cross sectional view of flat screen (3) below flattened gutter (2*b*) and below access port to housing (25).

Shows cross sectional view of slip connector (11) downstream end slips into female hub of separator housing (1*a*). Slip Connector (11) up-stream end slips into female hub of pipe elbow (150). Slip Connector (11) is manufactured Polyvinyl Chloride (PVC) pipe of proper size to mate with separator housing (1*a*) and pipe elbow (150).

Shows cross sectional view of trough base (14) engaged with slip connector (11) and trough interior side wall (15) by trough screw (13) to form trough channel (19) FIG. 22.

Shows cross sectional view of trough interior side wall (15) engaged with trough base (14) and slip connector (11) by trough screw (13).

I contemplate that trough base (14) and trough interior side wall (15) is manufactured Polyvinyl Chloride (PVC) pipe of proper size and shape to form trough base (14) and trough interior side wall (15), but other materials and sizes are also suitable. Shows side view of coupling (12) engaged in access port to housing (25) of separator housing (1*a*) and slip connector 11).

Shows drain tube adapter (5) engaged with drain port to coupling (26) of coupling (12 Access port to housing(25), coupling (12), drain port to coupling (26) and drain tube adapter (5) combine to form a hollow channel to drain water by gravity from flattened gutter (2*b*) to drain tube (6).

FIG. 22 This embodiment shows prospective view of separator housing (1*a*) with embodiments 3, 5,6,11,12,13,14,15, 19,20.

Test port (20) positioned in flat screen (3), within-separator housing (1*a*) is of multiply sizes to accept test probes. Flat screen (3) is located below trough interior side wall (15), and below slip connector (11).

Trough interior side wall (15) and trough base (14) attached to slip connector (11) with trough screw (13) to form trough channel (19) above flat screen (3).

Above flat screen (3) within separator housing (1*a*) access port to housing (25) engages coupling (12). drain tube adapter (5) engages drain port to coupling (26) of coupling (12). Drain tube (6) engages with drain tube adapter (5), which engages with coupling (12) which engages drain port to coupling (26).

Access port to housing (25), being open engages coupling (12) during normal radon mitigation system (200) operations. Coupling (12) engages drain tube adapter (5). Drain tube (6) engages drain tube adapter (5) to form a leak-proof water channel from separator housing (1*a*) to drain tube (6).

Figure 23:
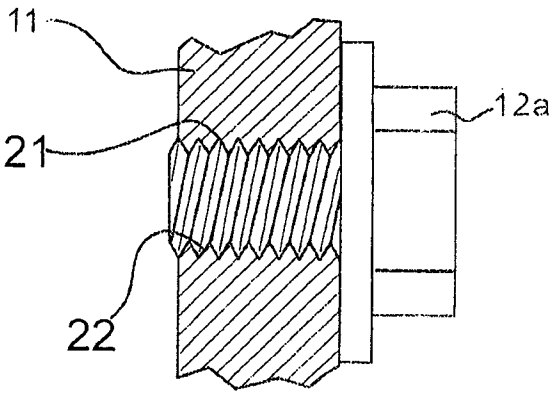
FIG. 23 Shows cross section view of drain port plug screwed into connector.

FIG. 23 This embodiment shows cross section view of connector port plug (12*a*) engaged with slip connector (11). Connector port Plug (12*a*) engages with slip connector (11) by mating access port thread (22) and access port plug thread (21). Mating access port threads (22) and access port plug threads (21) seals slip connector (11).

FIG. 24 This embodiment shows cross section view of access port threads (22) of hollow coupling (12) engaging access port coupling threads (21) of separator housing (1*a*) resulting in a hollow passageway. Drain tube adapter (5) engages and seals to coupling (12) with screw threads, resulting in a hollow passageway. Tube Drain tube (6) engages drain tube adapter (5) resulting in a hollow water tight passageway. Coupling (12) and drain tube adapter (5) are hollow to allow water passage from separator housing (1*a*) to drain tube (6).

Figure 25:
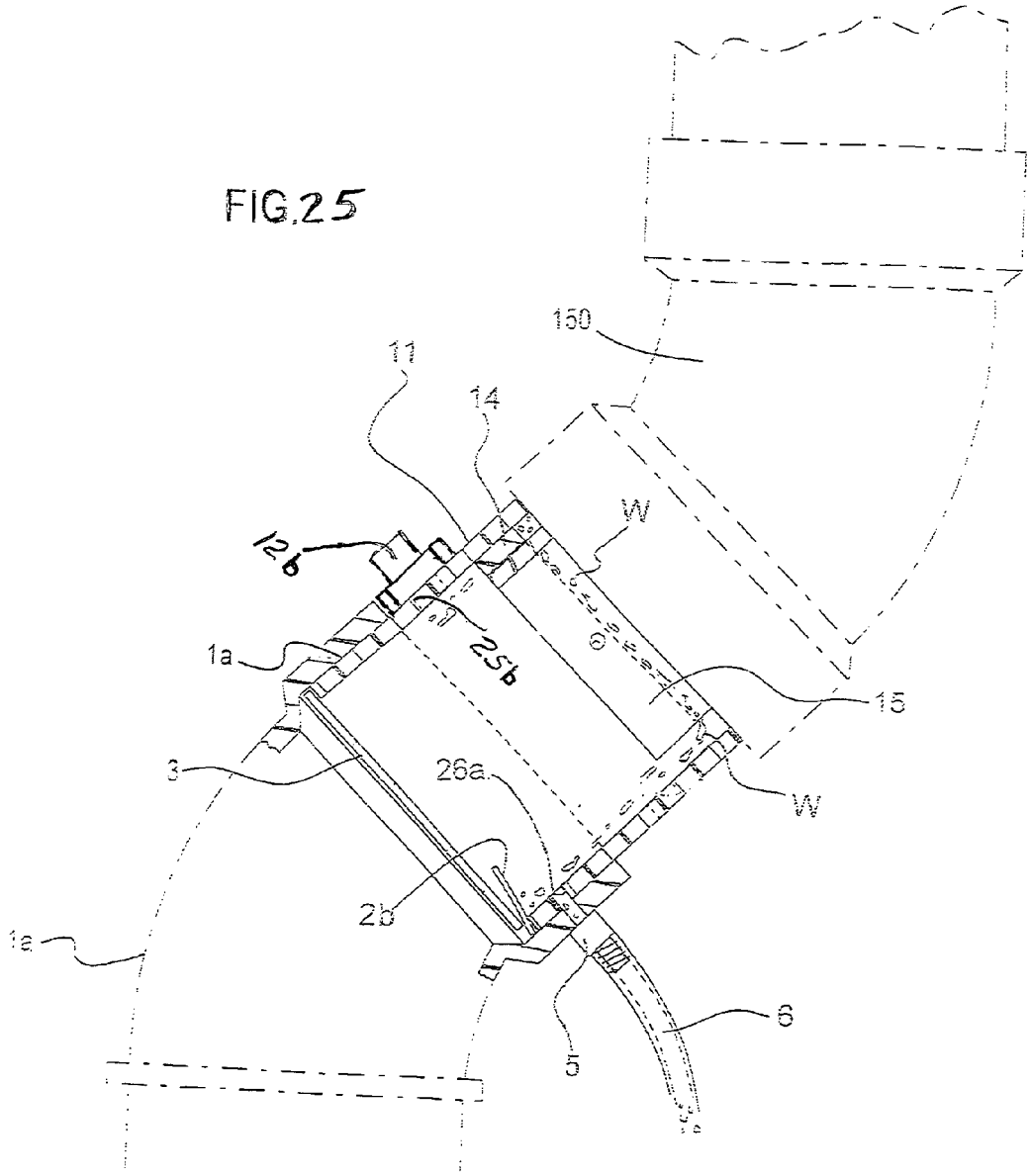
FIG. 25 Shows cross-sectional view of an embodiment of separator housing with rear connector port plug screwed into rear connector port.

FIG. 25. This embodiment shows rear connector port plug (12*b*) engaged with rear connector port (25*b*) engaged with slip connector (11) of separator housing (1*a*). Water (W) drains downward by gravity from hollow exhaust pipe elbow (150) through separator housing (1*a*) and water (W) continues downward by gravity through drain port to housing (26*a*) and through drain tube adapter (5) and through drain tube (6).

Those of skill in the art will appreciate that the principles of the present embodiment may be readily adapted for use outside of the field of radon mitigation.

At present I believe that this embodiment operates most efficiently, but the present embodiment can be further modified within the scope and spirit of this disclosure. This application is therefore intended to cover any variation, uses, or adaptation of the invention using its general principal. Further, this application is intended to cover such departures frOm the present disclosure as come within known or customary practices in the art to which this invention pertains.

Operation

Separator apparatus (1) of FIG. 1 and FIG. 10, is a means to protect radon fan (100) of radon mitigation system (200) from damage due to falling foreign objects such as water, ice, birds and animals and debris.

Separator apparatus (1) traps ice, birds and animals and debris before reaching radon fan (100) and retains same in collection area above screen (23) of separator housing (1*a*) Separator apparatus (1) intercepts water before reaching radon fan (100) and redirects same water around radon fan (100), channeling same water to suction pipe (140).

Separator apparatus(1), including separator housing (1*a*), elliptical cone gutter (2), semi-curved gutter (2*a*), flattened gutter (2*b*), flat screen(3), domed screen (3*a*), support screws (4), drain tube adapter (5), drain tube (6), drain tube adapter (7), drain tube insulation (8), sealant (9), slip connector (11), coupling (12), connector port plug (12*a*), trough screw (13), trough base (14), trough interior side wall (15), trough channel (19), test port (20), access port threads (22) access port plug threads (21) collection area above screen (23), drain port to coupling (26), drain port to housing (26*a*), access port to housing (25), access port to connector (25*a*). The separator apparatus (1) prevents foreign objects, such as ice, water, birds and animals, debris from entering radon fan (100) by catching and holding solid foreign objects in the collection area above screen (23). Additionally separator apparatus (1) catches and redirects water around radon fan (100) by trough channel (19) and elliptical cone gutter (2), semi-curved gutter (2*a*), flattened gutter (2*b*)) to drain tube(6), which empties into suction pipe(140).

Radon mitigation system (200) including separator apparatus (1), radon fan (100), flexible fan coupling (110), flexible fan coupling (120), pipe elbow (130), suction pipe (140), pipe elbow (150), exhaust pipe (160), birds and animals screen cap (24), exhaust pipe (160) support bracket (170), connected to building exterior wall (180).

Separator Housing (1*a*) is an additional embodiment of separator (1). Separator Housing (1*a*) of separator apparatus (1) being open at both entrance end and exit end, is an air passage-way receiving radon laced air from below and expelling the same radon laced air upward through pipe elbow (150) and into exhaust pipe (160) and out of birds and animals screen cap (24). Separator Housing (1*a*) is installed upstream of flexible fan coupling (110) and downstream pipe elbow (150).

I contemplate that separator housing (1*a*) be made of a Polyvinyl Chloride (PVC) typical schedule 40 or schedule 20 plumbing pipe elbow with 4" diameter hollow opening with 45 degree or 90 degree bend, but other materials, sizes and bend angles are also suitable.

Elliptical cone gutter (2) of FIG. 1,2,3.4,5,6,7,8,10,11,12, 13,14 is an additional embodiment of separator apparatus (1), which is shaped to allow maximum air passage with minimum air resistance and a form to direct water flow towards drain port to coupling (26), and drain port to housing (26*a*). Elliptical cone gutter (2), is located within separator housing (1*a*).

I contemplate that elliptical cone gutter (2) be configured to be elliptical cone shape, but other shapes are also suitable.

Semi-curved gutter (2*a*) of FIG. 15, 16 17, is an additional embodiment of separator apparatus (1), shaped to allow maximum air passage with minimum air resistance and a means to direct water flow towards drain port to coupling (26) and drain port to housing (26*a*). Semi-curved gutter (2*a*) is located within separator housing (1*a*).

I contemplate that semi-curved gutter (2*a*) is configured in a partial circular dome shape to engage circular domed screen (3*a*), but other shapes are also suitable.

Flattened gutter (2*b*) of FIG. 20, 21 is an additional embodiment of separator apparatus (1), shaped to allow maximum air passage with minimum air resistance and a means to direct water flow towards drain port to coupling (26) drain port to housing (26*a*).

Flattened gutter (2*b*) is attached to flat screen (3) at the outer edge of screen (3). Flattened gutter (2*b*) receives water from diversion trough (19) FIG. 22. Flattened gutter (2*b*) is located within separator housing (1*a*).

I contemplate flattened gutter (2*b*) to be configured in a flattened shape, installed with a slant towards drain port to coupling (26), drain port to housing (26*a*), but other shapes and angles are also suitable.

I contemplate that elliptical cone gutter (2), semi-curved gutter (2*a*) and flattened gutter (2*b*) be made of aluminum or plastic, but other materials are also suitable.

I contemplate that elliptical cone gutter (2) semi-curved gutter (2*a*) and flattened gutter (2*b*) is sized and positioned to minimize air resistance and maximize water collection within separator housing (1*a*).

Flat Screen (3) of FIGS. 3, 5,6,7,8,9,18,19,20,21 and 22 is an additional embodiment of separator apparatus (1). Flat Screen (3) prevents falling foreign objects from entering radon fan (100). Flat Screen (3) is a flat configuration and conforms to the interior cylinder shaped wall of separator housing (1*a*).

Flat Screen (3) mesh is sized to allow maximum air passage and prevent falling foreign objects from entering radon fan (100) Flat Screen (3) and elliptical cone gutter (2) FIG. 8, engage with separator housing (1*a*). Flat Screen (3) is supported within separator housing (1*a*) by support screws (4) FIG. 8.

Flat Screen (3) and elliptical cone gutter (2) FIG. 7, 8 are seated into sealant (9) to form a secure and waterproof bond with separator housing 1*a*).

I contemplate that flat screen (3), domed screen (3*a*) be made of stainless steel or galvanized steel, but other materials are also suitable.

I contemplate-flat screen (3) domed screen (3*a*) be of 16 gage with 0.50 inch openings, but other materials and sizes are also suitable.

Support screws (4) FIG. 8, are an additional embodiment of separator apparatus (1). Support screws (4) are installed into separator housing (1*a*) to support combinations of flat screen (3), domed screen (3*a*) and elliptical cone gutter(2), semi-curved gutter (2*a*), flattened gutter (2*b*). Support screws (4) FIG. 8 are installed and secured into separator housing (1*a*) wall.

I contemplate that support screws (4) FIG. 8 be constructed of stainless steel or zinc plated and sized 8×1 "A", but other materials and sizes are also suitable.

Drain tube adapter (5) FIG. 20, 21. Is an additional embodiment of separator apparatus (1). Drain tube adapter (5) is threaded on the entrance end to mate with threads of drain port to housing (26*a*) of separator housing (1*a*) FIG. 20.

Additionally, drain tube adapter (5) is threaded on the entrance end to mate with threads installed in the square head of coupling (12) FIG. 21.

Drain tube adapter (5) mates with drain tube (6) on the exit end FIG. 20, 21. Drain tube adapter (5) is a hollow water passageway from separator housing (1*a*) to drain tube (6), FIG. 20. Drain tube adapter (5) is a hollow passageway from coupling (12) to drain tube (6), FIG. 21.

I contemplate that drain tube adapter (5) and drain tube adapter (7) be constructed of polyutherene ⅜" MNPT threaded screw importing end by ⅜" barb exporting end, but other materials and sizes are also suitable. Drain tube (6) FIG. 1, 10, 18, 19, 20, 21 is an additional embodiment of separator apparatus (1). Entrance end of drain tube (6) mates with barbed exit end of drain tube adapter (5) and is a water passageway from drain tube adapter (5) to drain tube adapter (7) FIG. 1.

I contemplate that drain tube (6) be constructed of vinyl tubing, ½" OD×⅜" ID, but other materials and sizes are also suitable.

Drain tube adapter (7). FIG. 1,10,18,19. Is an additional embodiment of separator apparatus (1). Drain tube (7) mates with exit end of drain tube (6) and is a hollow non-leaking water passageway from drain tube (6). Drain tube adapter (7) mates with suction pipe (140).

I contemplate that drain tube adapter (7) is similar to drain tube adapter (5), but other materials and sizes are also suitable.

Drain tube insulation (8), FIG. 1,10,18,19. Is an additional embodiment of separator apparatus (1)

Drain tube insulation (8) surrounds drain tube (6) to insulate freezing temperatures from entering drain tube (6).

I contemplate that drain tube insulation (8) be of materials commercially available.

Sealant (9) FIG. 7, 8 is an additional embodiment of separator apparatus (1). Sealant (9) applied inside separator housing (1*a*) wall at elliptical cone gutter (2), semi-curved gutter (2*a*), flattened gutter (2*b*) and flat screen (3), domed screen (3*a*) junction. Sealant (9) engages and seals elliptical cone gutter (2) and edge of flat screen (3) and attaches to inside wall of separator housing (1*a*) at point of contact of elliptical cone gutter(2), semi-curved gutter (2*a*), flattened gutter (2*b*) and flat screen(3), domed screen (3*a*) and resting on support screws(4).

I contemplate that sealant (9) be waterproof Silicone, but other materials are also suitable.

Slip connector (11) FIG. 18, 19, 20, 21, 22. is an additional embodiment of separator apparatus (1). Slip Connector (11) is a cylindrical hollow Polyvinyl Chloride (PVC) pipe that inserts and engages its down-stream end into the up-stream female hub of separator housing (1*a*) to become engaged as one. Slip connector (11) inserts its up-stream end into the down-stream female hub of pipe elbow (150).

Slip connector (11) is a hollow interior passageway for radon laced air to flow through system (200). Down-stream section of slip connector (11) FIG. 21, is installed within separator housing (1*a*) exit hub to be as one. Up-stream section of slip connector (11) FIG. 21 is installed within down-stream hub of pipe elbow (150)

Down-stream portion of slip connector (11) FIG. 20 and up-stream separator housing (1*a*) hub combine to receive drain port to housing (26*a*) FIG. 20 and access port to housing (25) FIG. 21.

Up-stream portion of slip connector (11) FIG. 20 includes access port to connector (25*a*).

Connector (11) FIG. 21, is installed within and engaged with separator housing (1*a*) exit hub to be as one.

Slip connector (11) and separator housing (1*a*) FIG. 21 receives access port to housing (25).

The inside wall of up-stream portion of slip connector (11) FIG. 20, 21, 22 serves as the outside wall of channel (19) FIG. 22.

Slip Connector (11) is cemented to establish a watertight engagement to up-stream hub of separator housing (1*a*). Slip connector (11) is cemented to down-stream hub of pipe elbow (150).

I contemplate the slip connector (11) being 4" diameter, schedule 40 hollow interior Polyvinyl Chloride (PVC) pipe, but other sizes and materials are suitable.

Coupling (12) FIG. 19,21,22,23 is an additional embodiment of separator apparatus (1). Coupling (12) screws into drain port to coupling (26) of separator housing (1*a*) by mating access port plug threads (21) access port threads (22) FIG. 24. Coupling (12) is a removable device that engages part drain port to coupling (26) of separator housing (1*a*) during operation of radon mitigation system (200).

During radon mitigation system (200) operation, coupling (12) is fully engaged into drain port to coupling (26), resulting in an airtight seal of drain port to coupling (26) within separator housing (1*a*).

Coupling (12) engaged by drain tube adapter (5) FIG. 19, 21, 22 is an additional embodiment of separator apparatus (1). Coupling (12) square turning head with installed threads to accept drain tube adapter (5) FIG. 24. I contemplate that coupling (12) be manufactured of plastic and be 1.25" diameter-11.5NPT threads with square turning head, but other materials, sizes and are also suitable.

Connector port plug (12*a*) FIG. 20 is an additional, embodiment of separator apparatus (1). Connector port plug (12*a*) screws into access port to connector(25*a*) within slip connector (11) by mating with access port threads (21), access port plug threads (22) FIG. 23. Connector port plug (12*a*) is a removable device that engages with access port to connector (25*a*) of slip connector (11) during operation of radon mitigation system (200).

During radon mitigation system (200) operation, connector port plug (12*a*) is fully engaged into access port to connector (25*a*), resulting in an airtight seal of access port to connector (25*a*) within slip connector (11).

I contemplate that connector port plug (12*a*) be made of plastic and be 1.25" diameter-11.5 NPT threaded with square turning head, but other materials, sizes are also suitable.

Trough screw (13) FIG. 20, 21, 22 is an additional embodiment of separator apparatus (1). Trough screw (13) connects trough base (14) and trough interior side wall (15) to slip connector (11). This assembly forms trough channel (19) which receives water that would otherwise drain into radon fan (100) and directs same water towards elliptical cone gutter (2), semi-curved gutter (2*a*) flattened gutter (2*b*), which directs same water to drain port to housing (26*a*) drain port to coupling (26). Trough base (14) additionally is the floor of trough channel (19).

Trough base (14) is a spacer between slip connector (11) and trough interior side wall (15), additionally trough base (14) is the floor of trough channel (19). Trough interior side wall (15) as attached to trough base (14) is inside side wall of trough channel (19). Trough channel (19) connection joints between slip connector (11), trough base (14) and trough interior side wall (15) are sealed to prevent water leakage from trough channel (19). Trough channel (19) FIG. 22 is an additional embodiment of separator apparatus (1). Trough channel (19), comprised of trough interior side wall (15) attached to trough base (14) which is attached to slip connector (11) by trough screw (13). Trough channel (19) redirects water towards elliptical cone gutter (2), semi-curved gutter (2*a*) flattened gutter (2*b*).

I contemplate that trough interior side wall (15) and trough base (14) of this embodiment be manufactured of Polyvinyl Chloride (PVC), but other materials are also suitable.

Test port (20) FIG. 22 is an additional embodiment of separator apparatus (1). Test port (20) is an opening of flat screen (3) to accommodate testing probe equipment for measuring radon mitigation system (200) performance. Test port (20) is accessed with coupling (12) removed from access port (25) FIG. 22, which is a passageway for testing equipment to enter separator housing (1*a*).

Test port (20) is accessed with connector port plug (12*a*) removed from access port to connector (25*a*) FIG. 20, which is a passageway for testing equipment to enter slip connector (11).

Access port thread (22), FIG. 23 is an additional embodiment of slip connector (11). Access port plug thread (21) is as one with connector port plug (12*a*). Access port plug thread (21) mates access port thread (22) of slip connector (11).

Access port plug thread (21) FIG. 23 of connector port plug (12*a*) engage access port thread (22) rendering access port to connector (25*a*) closed and sealed.

Additionally access port coupling thread (22) is installed within separator housing (1*a*) FIG. 24

Access port coupling thread (21) of connector port plug (12*a*) mates access port thread (22) of separator housing (1*a*).

Access port thread (22) of connector port plug (12*a*) FIG. 23 is an additional embodiment of separator apparatus (1). Connector port plug (12*a*) seals access port to connector(25*a*) of slip connector (11) FIG. 20 by mating access port thread (22) of connector port plug (12*a*) with access port plug thread (21) of access port to connector (25*a*) of slip connector (11).

Slip connector (11) and access port to connector (25*a*) being sealed by connector port plug (12*a*) by access port plug thread (21) mating access port thread (22) to produce an airtight slip connector (11).

Collection area above screen (23) FIG. 22 is an additional embodiment of separator apparatus (1). Flat screen (3) prevents foreign objects such as debris, birds and animals, and ice from entering radon fan (100). Foreign objects which are stopped from entering radon fan (100) by flat screen (3) accumulate in the collection area above screen (23) located up-stream of flat screen (3). Removing foreign objects from collection area above screen (23) is accomplished by unscrewing and removing access port plug (12) from access port to housing (25) FIG. 21. Access port to housing (25) is a passageway to enter collection area above screen (23).

Additionally, removing foreign objects from collection area above screen (23) is accomplished by unscrewing and removing connector port plug (12*a*) from access port to connector (25*a*) of slip collector (11) FIG. 20. Access port to connector (25*a*) is a passageway to access collection area above screen (23) for foreign object removal.

Access port to housing (25) FIG. 19, 21, 22 is an additional embodiment of separator (1). Access port to housing (25) is an open passageway to receive water directed from elliptical cone gutter (2), semi-curved gutter (2*a*), flattened gutter (2*b*) of the separator housing (1*a*). Access port to housing (25) is an open passageway to coupling (12).

Drain port to coupling (26) FIG. 19, 21, 22 is an additional embodiment of separator apparatus (1). Drain port to coupling (26) is a threaded opening located within the square head of coupling (12). Drain port to coupling (26) receives drain tube adapter (5) by drain tube adapter (5) threads.

Access port to connector (25*a*) FIG. 18, 20 is an additional embodiment of separator apparatus (1). Access port to connector (25*a*) is a threaded open passageway of slip connector (11). Access port to connector (25*a*) is an open passageway into slip connector (11). Access port to connector (25*a*) screw threads mate with connector port plug (12*a*) to be substantially air-tight Access port to connector (25*a*) serves as a means to remove foreign objects from collection area above screen (23).

Drain port to housing (26*a*) FIG. 18, 20 is an additional embodiment of separator apparatus (1). Drain port to housing (26*a*) is an open waterway of separator housing (I a). Drain port to housing (26*a*) within separator housing (1*a*) engages drain tube adapter (5).

Drain port to housing (26*a*) is an open waterway to receive water from flattened gutter (2*b*) FIG. 20 and channel same water into drain tube adapter (5), to be exported into drain tube (6). Drain port to housing (26*a*) engages with drain tube adapter (5) with mating threads.

I contemplate that drain port to housing (26*a*) thread mate with drain tube adapter (5) thread, but other sizes are also suitable.

CONCLUSION, RAMIFICATIONS, AND SCOPE

Thus the reader will see that at least one embodiment of the separator provides a greater level of damage protection for a radon mitigation system and can be installed by those in the radon mitigation installation trade. While my above description contains much specificity, these should not be construed as limitations on the scope, but rather as an exemplification of one or several preferred embodiment thereof. Many other variations are possible. For example the gutter can have other shapes, such as domed, flattened, circular, oval, elliptical, and conical. Another example is the screen can have other shapes, such as domed, flattened, circular, oval, elliptical, and conical.

Multiply materials, sizes and designs of the embodiments are possible. Accordingly, the scope should be determined not by the embodiments illustrated, but by the appended claims and their legal equivalents.

I claim:

1. A separator apparatus in a radon mitigation system for blocking falling ice which forms inside said radon mitigation system, debris, birds and animals which enter from the discharge end of said radon mitigation system, for diverting condensate which forms inside said radon mitigation system, for permitting internal inspections and internal cleaning of said separator apparatus, for permitting access to the inside of said separator apparatus for air quality and air flow testing thereof to mitigate the damage to the radon fan, said radon mitigation system comprising an exhaust side having a hollow interior and an inner surface, a hollow flexible exhaust fan coupling, a separator apparatus, a hollow exhaust pipe elbow, a hollow exhaust pipe on which ice and condensate may be formed, a discharge end where debris, birds and animals may enter, a suction side having a hollow interior, and a radon fan apparatus interposed between said exhaust side and said suction side and coupled to each of said exhaust side and said suction side to form a conduit through which a gaseous fluid may be conveyed, wherein said gaseous fluid is drawn by said radon fan apparatus from said suction side and expelled by said radon fan apparatus through said exhaust side, said separator apparatus comprising:

a separator housing comprising a curved elbow having a first open end and a second open end and a continuous hollow interior between said first open end and said second open end communicating between said first open end and said second open end, said first open end communicating with said exhaust side of said radon fan exhaust hollow interior and said second open end communicating through said exhaust side to said hollow interior thereof at an angle to the vertical of said exhaust side in a manner that eliminates a direct vertical path to said radon fan apparatus for falling ice, debris, birds and animals which originates from the discharge side of said radon mitigation system and can damage said radon fan apparatus; and a screen, with the axis of said screen substantially coincident with the axis of said separator housing second open end, comprising a diameter being dimensioned to fit within said second open end of said separator housing, being arranged within said second open end of said separator housing in a manner forming a barrier comprising said inner surface of the second open end of said separator housing and the outer edge of said screen positioned to block falling ice, debris, birds and animals which may form and or enter said radon mitigation system and damage said radon fan apparatus; and a flattened gutter attached to said screen at the outer edge, said gutter installed with a slant towards a drain port as to collect condensate and melted ice which may drain within said separator housing a slip connector comprising a hollow interior having an inner surface, a first open end and a second open end, said hollow interior communicating between said first open end and second open end, said first open end communicating through said hollow exhaust pipe elbow to said hollow interior thereof and said second open end communicating with the said separator second open end in a manner to couple with the separator housing interior thereof; and a drain port comprising a hollow interior having a first open end and a second open end, said hollow interior communicating between said first open end and said second open end, said first open end of said drain port communicating through said separator housing and said slip connector to said hollow interior there of immediately adjacent to the lowest point of said conical surface of said gutter and within said gutter, said second open end communicating with the outside of the said separator housing; and a coupling comprising a hollow interior having a first open end and a second open end, said hollow interior communicating between said first open end and said second open end, said first open end of said coupling configured to facilitate a water tight connection between said second open end of said drain port; and a drain tube comprising a hollow interior having a first open end and a second open end, said hollow interior communicating between said first open end and said second open end, said first open end of said drain tube communicating through said coupling to said separator housing and said slip connector to said hollow interior there of immediately adjacent to the lowest section of said conical surface of said gutter and within said gutter, and second open end of said drain line communicating through hollow suction side to said hollow suction side interior whereby said condensate and water may be received from said gutter by said drain tube and conducted through said drain tube into said hollow suction pipe; and an access port with access port plug located in said slip connector adjacent to the said first open end of said housing diametric to and offset from said drain tube comprising a hollow interior having a first open end and a second open end, said hollow interior communicating between said first open end and said second open end, said first open end of said access port communicating with the outside of said slip connector and the second open end communicating with the interior of the said separator apparatus; and a trough channel mounted on the interior surface of said slip connector substantially coincident with the axis of said slip connector having a trough interior side wall, a trough base and a trough screw comprising a first semi-cylindrical edge and a second semi-cylindrical edge, said first semi-cylindrical edge communicating through said exhaust side of said slip connector to said hollow interior there of and said second semi-cylindrical edge communicating with said suction side of said slip connector, said first and second semi-cylindrical edges are parts of homogeneous semi-cylindrical rectangular said trough interior side wall diametric to said drain tube centered over and the said second semi-cylindrical edge clear of said access port with the space created by the said semi-cylindrical configuration centered on and facing said drain tube, said semi-cylindrical rectangular shaped trough interior side wall retained by said trough screw against a semi-cylindrical rectangular shaped trough base diametric to said drain tube and centered over said access port with space created by the said semi-cylindrical configuration centered on and facing the said drain tube having the same length as said trough interior side wall with a width less than said trough interior side wall offset from said first semi-cylindrical edge of said trough channel to create an edge, said semi-cylindrical shaped trough base retained by said trough screw to said interior wall of said slip connector establishing said trough channel, said trough screw inserted through a hole in the exterior side wall of said slip connector, centered above said access port and screwed into center of said trough base and said trough interior side wall, said trough channel positioned to collect condensate which may form in said hollow exhaust pipe that may flow to said separator apparatus.

2. Said screen of claim 1, in which said screen is a domed screen having a radius facing said exhaust pipe elbow (150).

3. Said screen of claim 1 wherein said screen made of stainless steel mesh with 0.50 inch openings.

4. Said screen of claim 1, wherein said screen has a test port comprising an opening in the center of said screen to accommodate a testing probe.

5. The separator housing of claim 1 wherein sealant is applied inside said separator housing at point of contact between said screen, said gutter and inside wall of the separator housing.

* * * * *